US008375925B2

(12) United States Patent
Ichikawa et al.

(10) Patent No.: US 8,375,925 B2
(45) Date of Patent: Feb. 19, 2013

(54) VAPORIZED FUEL PROCESSING DEVICE AND METHOD

(75) Inventors: Takashi Ichikawa, Kuki (JP); Masaru Nakano, Sayama (JP)

(73) Assignee: Mahle Filter Systems Japan Corporation, Tokyo (JP)

( * ) Notice: Subject to any disclaimer, the term of this patent is extended or adjusted under 35 U.S.C. 154(b) by 556 days.

(21) Appl. No.: 12/639,383

(22) Filed: Dec. 16, 2009

(65) Prior Publication Data

US 2010/0154755 A1 Jun. 24, 2010

(30) Foreign Application Priority Data

Dec. 18, 2008 (JP) ..... 2008-321692

(51) Int. Cl.
*F02M 33/06* (2006.01)

(52) U.S. Cl. ..... 123/519

(58) Field of Classification Search ..... 123/518–521
See application file for complete search history.

(56) References Cited

U.S. PATENT DOCUMENTS

| | | | | |
|---|---|---|---|---|
| 5,085,197 | A * | 2/1992 | Mader et al. | 123/520 |
| 5,386,812 | A * | 2/1995 | Curran et al. | 123/520 |
| 6,689,196 | B2 * | 2/2004 | Amano et al. | 96/112 |
| 6,823,851 | B2 * | 11/2004 | Amano et al. | 123/520 |
| 7,513,244 | B2 | 4/2009 | Potier | |
| 7,900,607 | B2 * | 3/2011 | Lang et al. | 123/518 |

FOREIGN PATENT DOCUMENTS

| | | |
|---|---|---|
| JP | 58-111348 U | 7/1983 |
| JP | 2-131066 U | 10/1990 |
| JP | 2004-36600 A | 2/2004 |

* cited by examiner

*Primary Examiner* — Stephen K Cronin
*Assistant Examiner* — Arnold Castro
(74) *Attorney, Agent, or Firm* — Foley & Lardner LLP

(57) ABSTRACT

In vaporized fuel processing device and method, an adsorption material provides a canister and configured to once hold the vaporized fuel generated in a fuel tank into the adsorption material within the canister, the canister into which an intake air pressure of an engine used for purge air being introduced when the engine is operated and purge air purging fuel corresponding to vaporized fuel from the adsorption material to be supplied to the engine; an electric heater configured to variably control an electric power supplied to the heater in accordance with a purge air quantity to be introduced within the canister.

9 Claims, 2 Drawing Sheets

VAPORIZED FUEL PROCESSING DEVICE AND METHOD

BACKGROUND OF THE INVENTION (1) Field of the Invention

The present invention relates to vaporized fuel processing device and method which temporarily hold vaporized fuel generated in a fuel tank by means of an adsorption material installed within a canister, to supply vaporized fuel into an engine by purging the fuel corresponding to the vaporized fuel from the adsorption material during an operation of an engine, and, particularly, relates to the vaporized fuel processing device and method which can achieve an improvement in an efficiency of the engine.

(2) Description of Related Art

In such a kind of vaporized fuel processing devices as described above, a purge air is introduced into the canister through an intake air negative pressure of the engine. The purge air purges a fuel held on the adsorption material so that a latent heat of an evaporation causes the material to be cooled. Then, the fuel becomes difficult to be purged from the adsorption material. To avoid this difficulty, an electric heater made of a, so-called, PTC (Positive Temperature Coefficient) thermister serves to heat the adsorption material so that a purge efficiency is improved. This process is described in a Japanese Utility Model Registration Application Publication No.showa 58-111348 published on Jun. 29, 1983.

In a previously proposed vaporized fuel processing device disclosed in the Japanese Utility Model Registration Application Publication, a switching on or off of an electric power supply to an electric heater is carried out in response to an intake air pressure to the engine in the same way as a purge control valve. At the same time when the start of introduction of the purge air into the canister, On or off operation is carried out when the power supply to the electric heater has been started. At the same time when the purge air introduced into the canister, the power supply to the electric heater is started.

SUMMARY OF THE INVENTION

It should, herein, be noted that a heat quantity deprived from the adsorption material during the purge of the fuel becomes larger, as the purge air quantity to be introduced into the canister becomes larger and, in other words, as the fuel purged from the adsorption material becomes increased. It is desirable to set an electric power to be supplied to the electric heater to obtain a sufficient quantity of heat. However, if the above-described setting is carried out in the technique disclosed in the above-identified Japanese Utility Model Registration Application Publication, a relatively large power is supplied to the electric heater even when the purge air quantity is small. There are possibilities that a consumed electric power becomes increased, a vehicular battery becomes overloaded, and a life of the previously proposed vaporized fuel processing device becomes shortened. In addition, when the electric power supply to the electric heater is carried out under an engine cold state, a relatively large quantity of electric power is temporarily consumed due to a temperature rise in the electric heater so that, according to the case, an over current is caused to flow through a fuse attached onto a power supply for a safety purpose may be melted to turn off the power supply from the vehicle battery.

It is, therefore, an object of the present invention to provide vaporized fuel processing apparatus and method in which a consumed power of the electric heater can be reduced, while the purge efficiency of the canister can be improved.

According to one aspect of the present invention, there is provided a vaporized fuel processing device comprising: an adsorption material provided within a canister and configured to once hold vaporized fuel generated in a fuel tank into the adsorption material provided within the canister, the canister into which an intake air pressure of an engine used for purge air being introduced when the engine is operated and purge air purging fuel corresponding to vaporized fuel from the adsorption material to be supplied to the engine; an electric heater configured to heat the adsorption material; and a control section configured to variably control an electric power supplied to the heater in accordance with a purge air quantity to be introduced within the canister.

According to another aspect of the present invention, there is provided a vaporized fuel processing method comprising: once holding vaporized fuel onto an adsorption material within a canister; purging fuel corresponding to vaporized fuel from the adsorption material to be supplied to an engine through purge air introduced into the canister using an intake air pressure of an engine when the engine is operated, an electric heater being used to heat the adsorption material; and variably controlling an electric power to be supplied to the electric heater in accordance with a purge air quantity to be introduced within the canister.

DETAILED DESCRIPTION OF THE INVENTION

Reference will hereinafter be made to the drawings in order to facilitate a better understanding of the present invention.

Figure 1:
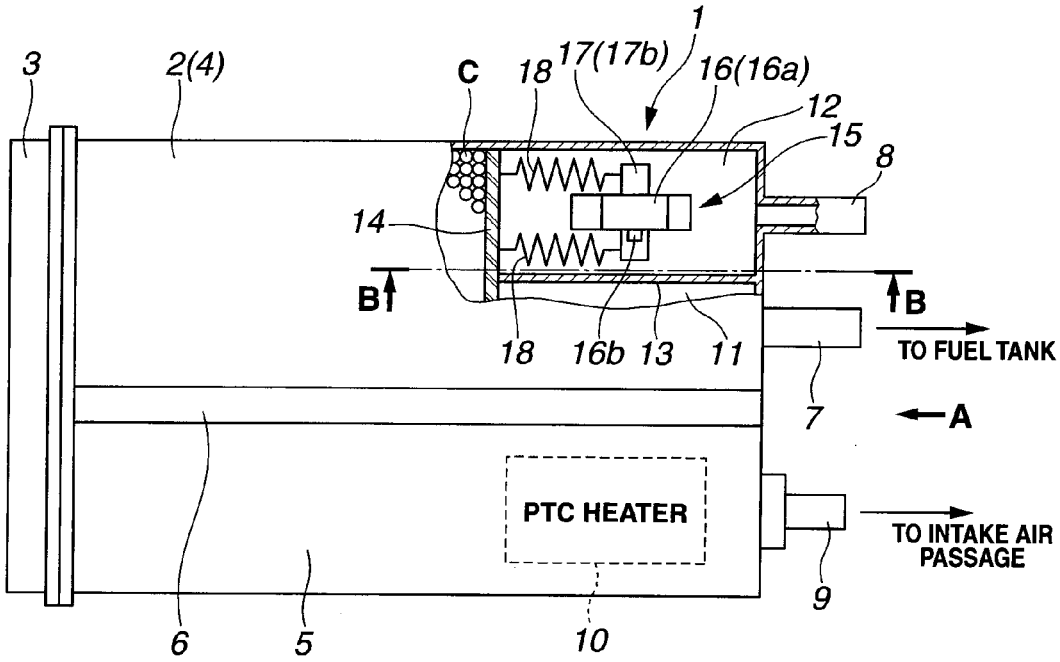
FIG. 1 is a partially cut plan view representing a canister as a preferred embodiment according to the present invention.
Figure 2:
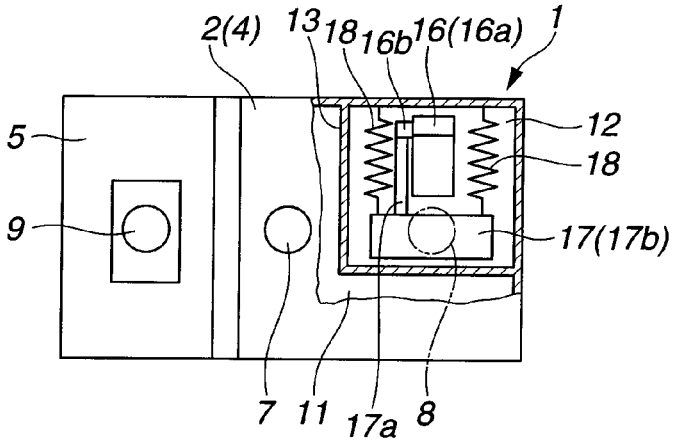
FIG. 2 is an arrow marked view along a line of A shown in FIG. 1.
Figure 3:
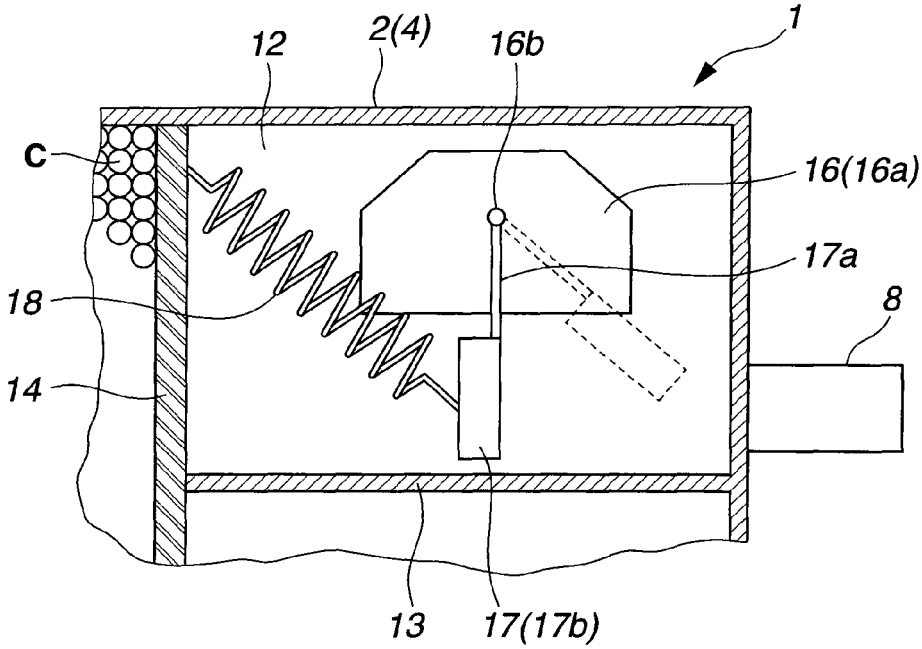
FIG. 3 is a cross sectional view cut away along a line of B-B shown in FIG. 1.

FIGS. 1, 2, 3, and 4 show a preferred embodiment of a vaporized fuel processing device according to the present invention. FIG. 1 shows a partially cut plan view of a canister in the vaporized fuel processing device according to the present invention. FIG. 2 shows an arrow marked A directional view shown in FIG. 1. FIG. 3 shows a cross sectional view cut away along a line of A in FIG. 1. FIG. 3 shows a cross sectional view cut away along a line of B-B shown in FIG. 1.

As shown in FIGS. 1 through 3, canister 1 of the vaporized fuel processing device according to the present invention is depicted. Canister 1 includes a canister main body 2 in which an activated carbon C which is an adsorption material is stored; and an encapsulation 3 which closes an opening end of canister main body 2. It should be noted that canister main body 2 and encapsulation 3 are formed of synthetic resin material and are mutually fixed with each other, respectively, for example, through a melting.

Canister main body 2 is provided with a first housing portion 4 and a second housing portion 5, each of both housing portions 4, 5 constituting a bottomed square cylindrical shape. Active carbon C is filled within each of these first and second housing portions 4, 5. Both of housing portions 4, 5 are mutually linked with each other via a reinforcement rib 6 and canister main body 2 is approximately rectangular parallelepiped shape as a whole.

A bottom wall portion of first housing portion 4 includes: a charge port 7 connected to a fuel tank; and a purge port 8 connected to an intake air passage of an engine. On the other hand, an atmospheric port 9 configured to be open to the atmosphere is installed on a bottom wall portion of second housing portion 5. In addition, an inner space of first housing portion 4 and an inner space of second housing portion 5 are communicated with a connection passage formed within encapsulation 3. A passage in an approximately letter U shape which is folded back via the connection passage is formed within canister 1.

Then, as is well known, the vaporized fuel generated on the fuel tank is introduced into an inside of canister main body 2 from charge port 7 so that the vaporized fuel developed on the fuel tank during, for example, a stop of a vehicle in which the vaporized fuel processing device is installed to adsorb and hold the vaporized fuel into active carbon C within both housing portions 4, 5. While, in an operation of the engine, the purge air introduced according to intake air pressure of the engine is communicated with connection passages formed within encapsulation 3 is used to purge the fuel corresponding to the vaporized fuel held on active carbon C. An air mixture between purge air and fuel described above is supplied from purge port 8 into intake air passage of an engine.

It should, herein, be noted that, when fuel is purged from active carbon C, an ambient temperature value is reduced due to an evaporation latent heat of fuel so that a purge efficiency is reduced.

Hence, a PTC heater constituted by a PTC thermister is disposed within second housing portion 5 as the electric heater. Then, PCT heater 10 warms up not only active carbon C placed in the proximity to PTC heater 10 but also active carbon C within whole canister 1 by a heat transfer due to the introduction of the purge air from atmospheric port 9 so that the purge effect of canister 1 is improved.

On the other hand, within first housing portion 4, a partition wall 13 to divide space at the bottom side of first housing section 4 into vaporized fuel exhaust chamber 12 in an approximately rectangular shape of cross section communicated with purge port 8 and vapor fuel introduction chamber 11 communicated with charge port 7 and a tip of partition wall 13 serves to support a filter 14 having a high ventilation characteristic (breathability). In addition, active carbon C is held at an anti-purge port 8 of filter 14.

Furthermore, a metering unit 15 configured to variably control an electric power supplied to PTC heater 10 in accordance with the purge air quantity, metering unit 15 measuring the purge quantity introduced into canister 1 in the vaporized fuel exhaust chamber 12 constituting a part of the flow passage of the purge air within canister 1. It should be noted that metering unit 15 is preferably installed in the proximity to purge port 8 in the flow passage of purge air within canister 1 as nearly as possible. Thus, the flow quantity of purge air flowing out from canister 1 can be measured with high accuracy.

Metering unit 15 includes: a flap 17 which is operated in accordance with a flow quantity of purge air flow passage within vaporized fuel exhaust chamber 12; and a rotary potentiometer 16 intervened in the electric circuit to supply the electric power to PTC heater 10 as will be described later and which serves as a variable resistor whose resistance value is changed in accordance with an opening angle of flap 17.

Potentiometer 16 includes: a casing 16*a;* and an input shaft 16*b* projected in a direction approximately orthogonal to a flow direction of the purge air from casing 16*a*. A resistance value of potentiometer 16 is varied along with a rotation of input shaft 16*b*.

On the other hand, flap 17 includes: a flap main body 17*b* in an approximately rectangular plate shape; a linkage axle 17*a* linked with flap main body 17*b* and input shaft 16*b* of potentiometer 16. Flap 17 is installed to enable a rotation operation integrally with input shaft 16*b* in a rotational direction with input shaft 16*b* as a center. When the flow of purge air is not provided, flap main body 17*b* overlaps with purge port 8 on a projection plane in a stream direction of the purge air and is positioned at a steady-state stationary position at which flap 17 takes a posture orthogonal to a stream direction of purge air. In other words, flap main body 17*b* closes a part of vaporized fuel exhaust chamber 12 at which purge port 8 in a height direction of vaporized fuel chamber 12 so that a cross sectional area of the flow of vaporized fuel exhaust chamber 12 becomes narrowed. On the other hand, as denoted in a continual dot line in FIG. 3, when purge air is caused to flow within vaporized fuel exhaust chamber 12 by pressing flap main body 17*b* on purge air flow, the flow passage of purge air is opened by means of purge air is widened, thus flap 17 being pivoted from the steady-state stationary position to purge port 8.

In more details, each of one ends of a pair of return springs 18 is linked to a corresponding width directional end of flap main body 17*b* to bias flap 17 toward its close direction (an anti-purge port 8 from a standpoint of a pivotal direction of flap 17). Both return springs 18 are arranged to be oriented in an oblique upward direction toward a filter 14 and the other ends of pair of return springs 18 are linked to canister main body 2 at corner portions formed between upper wall of vaporized fuel exhaust chamber 12 and filter 14. Thus, a region of a projected plane in a flow direction of purge air and formed to become as narrow as possible so that purge air is efficiently brought in close contact with flap main body 17*b* at that region, thereby this making an efficient contact on purge air onto flap main body 17*b*. It should be noted that, although not shown in the drawings, hooks may be provided on both ends of pair of return springs 18 and engagement portions which engage relatively rotatably with these hooks are installed at flap main body 17*b* and canister main body 2, respectively, with a connection to these hooks. It is preferable to make flap 17 smoothly operated by relatively enabling swing with respect to flap main body 17*b* and canister main body 2 in the rotation direction with respective hooks as a center. In addition, when no flow of purge air is present, a stopper to limit a pivotal motion of flap 17 toward the anti-purge port 8 serves to hold flap 17 at the steady-state stationary position.

That is to say, when purge air is caused to flow into vaporized fuel exhaust chamber 12, flap 17 is pivoted at a position at which a force to press flap main body 17*b* toward purge port side 8 and a biasing force of pair of return springs 18 are balanced. In other words, the force of purge air depressing flap main body 17*b* toward purge port 8 is increased along with an increase in a flow quantity of purge air. Flap 17 is, accordingly, pivoted at a position varied in accordance with the flow quantity of purge air. It should be noted that a pivotal displacement of flap 17 in accordance with the flow quantity of purge air is adjustable according to a magnitude of the received pressure surface of flap main body 17*a* which is pressed by the flow of the purge air and spring constants of pair of return springs 18.

Figure 4:
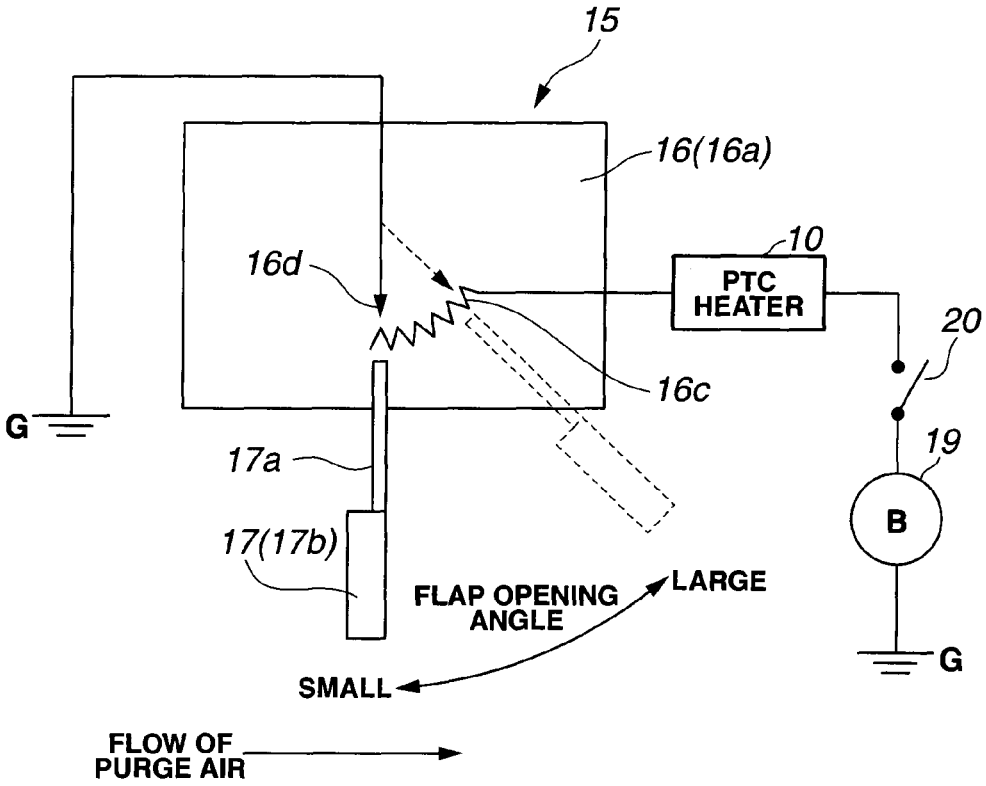
FIG. 4 is a rough configuration view of an electric circuit to supply an electric power to a PTC heater shown in FIG. 1.

Next, FIG. 4 shows a conceptual view of an electric circuit to supply the electric power to PTC heater 10. As shown in FIG. 4, PTC heater 10 is connected to a positive pole side of battery 19 which serves as a DC power supply via an ignition switch 20.

A negative pole side of PTC heater 10 is grounded as ground G via potentiometer 16. In other words, PTC heater 10 and potentiometer 16 are serially connected together. Battery 19 has a negative pole side grounded as ground G.

In details, in a casing 16*a* of potentiometer 16, coil 16*c* having a resistance body in an arc shape and a brush 16*d* as a movable body which is brought in contact with coil 16*c* are housed respectively, one end of coil 16*c* being interconnected with the negative pole side of PTC heater 10 and brush 16*d* being grounded as ground G. Brush 16*d* is mechanically linked with an input shaft 16*b* which is rotated together with flap 17 via an interlocking mechanism. Brush 16*d* is slid in an elongate direction of coil 16*c* on coil 16*c* interlinked with the rotation of input shaft 16*a*. Then, according to the operation of brush 16*d,* a distance between PTC heater 10 side end portion and brush 16*d* is varied so that the electrical resistance in potentiometer 16 is continuously varied. It should be noted that the electrical resistance in potentiometer 16 is set to be maximum when flap 17 is placed at the steady-state stationary position. As an opening angle of flap 17 becomes larger (wider), its electrical resistance becomes decreased (as shown in FIG. 4).

In other words, in the embodiment described above, the opening angle of flap 17 is varied in accordance with the purge air quantity introduced into canister 1. According to the variation in the electrical resistance of potentiometer 16, a voltage applied to PTC heater 10 is increased or decreased. As described above, the electric power supplied to PTC heater 10 is controlled in accordance with the purge air introduced into canister 1.

More specifically, PTC heater 10 has, generally, such a characteristic that a, so-called, rush current occurs so that a large electric power is consumed when a large current is caused to flow and, thereafter, the current is caused to become small as the time has elapsed. Thus, the electric power consumed is reduced. When the ignition switch 20 is turned to ON, the engine is in the stop state. Hence, the purge air flow quantity introduced into canister 1, namely, the flow quantity of the purge air within vaporized fuel quantity exhaust chamber 12 becomes zeroed and the electrical resistance of potentiometer 16 is at the maximum value. Thereby, PTC heater 10 suppresses the electrical power as is consumed to be a rush electric power.

Then, when the purge air quantity introduced into canister 1 from atmospheric chamber 9 is increased with the engine driven (operated), flap 17 described above is open due to the flow of purge air in vaporized fuel exhaust chamber 12 so that the electrical resistance of potentiometer 16 is decreased and the voltage applied across PTC heater 10 is increased. Thus, a heat generation quantity of PTC heater 10 is increased and active carbon C is sufficiently increased so that active carbon C is sufficiently heated and the fuel is efficiently purged.

Hence, in this embodiment, according to the flow quantity of the purge air within canister 1, the electric power to PCT heater 10 is variably controlled. Consequently, the flow quantity of the purge air in canister 1, viz., the quantity of fuel purged from active carbon C is relatively large so that, when the large quantity of the electric power is deprived from canister 1, the relatively large electric power is supplied to PCT heater 10 to obtain the sufficient quantity of heat generation quantity. On the other hand, when the flow quantity of purge air within canister 1, namely, the quantity of fuel purged from active carbon C is relatively small and the heat quantity obtained from active carbon C is relatively small, the electric power to be supplied to PTC heater 10 is suppressed so that the power consumption can be suppressed with the power supply quantity to PTC heater 10 reduced while the purge efficiency of canister 1 is improved.

In addition, PTC heater 10 has a feature such that the electrical resistance is increased along with the increase in the temperature of ambient temperature and has a function of self adjustment of the ambient temperature of PTC heater itself. Hence, the ambient temperature of PTC heater 10 does not rise to a temperature equal to or higher than a predetermined design temperature. Thus, the use of PTC heater 10 is safe and has a better electrical efficiency.

It should be noted that, in the embodiment described above, the example of application is to the vaporized fuel processing device using a, so-called, two chamber type canister 1. However, the present invention is not limited to this. The present invention is applicable to any type of the canister.

This application is based on a prior Japanese Patent Application No. 2008-321692 filed in Japan on Dec. 18, 2008. The entire contents of this Japanese Patent Application No. 2008-321692 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A vaporized fuel processing device comprising:

an adsorption material within a canister and configured to temporarily hold vaporized fuel generated in a fuel tank in the adsorption material within the canister, the canister into which an intake air pressure of an engine used for purge air is introduced when the engine is operated and purge air purging fuel corresponding to vaporized fuel from the adsorption material is to be supplied to the engine;

an electric heater configured to heat the adsorption material; and a control section configured to variably control an electric power supplied to the electric heater in accordance with a purge air quantity to be introduced within the canister, wherein the control section includes:

a flap arranged to interrupt a flow passage of the purge air within the canister; and a variable resistor intervened in an electric circuit in order for an electric power to be supplied to the electric heater to vary, an electrical resistance of the variable resistor varying in accordance with a position of the flap, and wherein the electrical resistance of the variable resistor is decreased along with an increase in the electric power.

2. The vaporized fuel processing device as claimed in claim 1, wherein the electric heater is a PTC heater.

3. The vaporized fuel processing device as claimed in claim 2, wherein the PTC heater comprises a PTC thermistor.

4. The vaporized fuel processing device as claimed in claim 1, wherein the electrical resistance of the variable resistor is continuously varied in accordance with the position of the flap.

5. The vaporized fuel processing device as claimed in claim 1, further comprising a vaporized fuel exhaust chamber in which no adsorption material is filled at a position immediately before a purge port of an internal space of the canister and wherein the flap is within the vaporized fuel exhaust chamber.

6. The vaporized fuel processing device as claimed in claim 1, wherein the variable resistor is serially connected with a PTC heater constituting the electric heater.

7. The vaporized fuel processing device as claimed in claim 1, wherein, as an opening angle of the flap is increased, the electrical resistance of the variable resistor is decreased.

8. The vaporized fuel processing device as claimed in claim 1, wherein an opening angle of the flap is set to become wider and the electrical resistance of the variable resistor is set to become smaller as a flow quantity of the purge air becomes larger.

9. A vaporized fuel processing method comprising:

temporarily holding vaporized fuel in an adsorption material within a canister;

purging fuel corresponding to vaporized fuel from the adsorption material to be supplied to an engine through purge air introduced into the canister using an intake air pressure of an engine when the engine is operated, an electric heater being used to heat the adsorption material; and variably controlling an electric power to be supplied to the electric heater in accordance with a purge air quantity to be introduced within the canister through a control section, wherein the control section includes:

a flap arranged to interrupt a flow passage of purge air within the canister; and a variable resistor intervened in an electric circuit in order for an electric power to be supplied to the electric heater to vary, an electrical resistance of the variable resistor varying in accordance with a position of the flap, and wherein the electrical resistance of the variable resistor is decreased along with an increase in the electric power.

* * * * *